US005262291A

United States Patent [19]

Slusarek et al.

[11] Patent Number: 5,262,291

[45] Date of Patent: Nov. 16, 1993

[54] PHOTOGRAPHIC ELEMENTS CONTAINING RELEASE COMPOUNDS

[75] Inventors: Wojciech Slusarek; Daniel L. Kapp, both of Rochester, N.Y.

[73] Assignee: Eastman Kodak Company, Rochester, N.Y.

[21] Appl. No.: 922,298

[22] Filed: Jul. 30, 1992

[51] Int. Cl.[5] ..... G03C 7/32; G03C 7/38

[52] U.S. Cl. ..... 430/544; 430/223; 430/226; 430/543; 430/549; 430/955; 430/957; 430/959

[58] Field of Search ..... 430/222, 223, 226, 544, 430/955, 543, 549, 548, 957, 959

[56] References Cited

U.S. PATENT DOCUMENTS

| | | | |
|---|---|---|---|
| 4,248,962 | 2/1981 | Lau | 430/382 |
| 4,358,525 | 11/1982 | Mooberry et al. | 430/544 |
| 4,886,736 | 12/1989 | Nakamura et al. | 430/544 |
| 4,908,293 | 3/1990 | Katoh et al. | 430/264 |
| 5,071,735 | 12/1991 | Ichijima et al. | 430/544 |

FOREIGN PATENT DOCUMENTS 0335319 10/1989 European Pat. Off. .

*Primary Examiner*—Richard L. Schilling
*Attorney, Agent, or Firm*—Joshua G. Levitt

[57] ABSTRACT

There are described color photographic elements containing novel release compounds which rapidly release a photographically useful group, such as a development inhibitor, from a timing group.

10 Claims, No Drawings

PHOTOGRAPHIC ELEMENTS CONTAINING RELEASE COMPOUNDS

FIELD OF THE INVENTION

This invention relates to silver halide color photographic elements containing novel release compounds. In a particular aspect, it relates to photographic elements containing release compounds with novel timing groups.

BACKGROUND OF THE INVENTION

Images are formed in silver halide color photographic materials by reaction between oxidized silver halide developing agent, resulting from the imagewise reduction of silver halide to metallic silver, and a dye-forming compound known as a coupler. It has become common practice to modify photographic properties of the image, such as sharpness, granularity and contrast, by the use of a image modifying compound commonly referred to as a development inhibitor releasing (DIR) coupler. Such materials were first described in U.S. Pat. Nos. 3,148,062 and 3,227,554.

More recently, U.S. Pat. No. 4,248,962, 4,409,323, and 4,500,633 have described release compounds from which a development inhibitor is released from an intervening group, called a timing group, after that group is released from the carrier portion of the compound.

U.S. Pat. No. 4,248,962 describes release compounds represented by the structure COUP-TIME-PUG, where COUP is a coupler group, PUG is a photographically useful group and TIME is a timing group. The timing group can be represented by the structure: -Nu-LINK-E-where Nu is a nucleophilic group, LINK is a linking group that provide the appropriate spatial relationship to permit an intramolecular displacement reaction to occur and E is an electrophilic group.

The use of a timing group provides a way to separate the release function from the photographic function and permits these separate functions to be designed into the compound in an optimal manner. Thus, control over the rate, location and time of the release of the development inhibitor can be optimized by the use of a separate timing group.

In addition to development inhibitors other photographically useful groups may desirably be released in an imagewise manner during photographic processing. Such groups include development accelerators, complexing agents, toners, stabilizers, etc.

It has been difficult to provide heterocyclic nitrogen release compounds, such as pyrazolone couplers, that are substituted in the coupling position. Such compounds frequently are unstable, or have poor reactivity as couplers, or both. This is exacerbated when the substituent is an oxygen-linked group.

When it is desired that the photographically useful group released in the element not act in the immediate vicinity of the site of release, an intervening timing group preferably is used, as described in U.S. Pat. No. 4,248,962, referred to above. However, we have found that known timing groups are not ideal for attachment to pyrazolone couplers. With these couplers, there generally is a trade-off between the stability of the release compound and the ability of the timing group to rapidly release the photographically useful group.

Thus, a problem to be solved by this invention is to provide release compounds containing novel timing groups, especially those which can be attached to heterocyclic nitrogen carriers, such as pyrazolone couplers, to provide stable compounds that release photographically useful groups at a relatively rapid rate so as to provide a desired photographic effect.

SUMMARY OF THE INVENTION

We have found that this can be accomplished with a release compound containing a novel timing group in which the electrophile is an electron deficient aromatic carbon atom to which is directly attached either the photographically useful group or another timing group. Thus, in accordance with this invention there is provided a photographic element comprising a support bearing a silver halide emulsion layer having associated therewith an image dye forming coupler and a release compound comprising a carrier group, a timing group, and a photographically useful group, wherein the timing group, TIME, is represented by the formula:

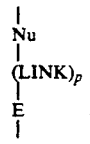

wherein:

Nu is a nucleophilic group;

E is an electrophilic group, comprising one or more carbo- or hetero- aromatic rings, containing an electron deficient carbon atom;

LINK is a linking group which provides 1 to 5 atoms in the direct path between the nucleophilic site of Nu and the electron deficient carbon atom in E;

p is 0 or 1;

the photographically useful group is attached to an electron deficient carbon atom in E directly or through another timing group; and the nucleophilic group is joined, directly or thru an intervening timing group, to a position on the carrier group from which it is released during photographic processing.

Electon deficient aromatic groups have been described in the art as blocking groups for photographically useful groups that are to be released during photographic processing in U.S. Pat. No. 4,908,293, and E.P. Published Application 0 335 319. However, the aromatic group is not joined to a carrier group and unblocking occurs in a uniform fashion under processing conditions without release from another moiety.

Thus, this invention provides release compounds that are stable in photographic elements under conditions of storage, but which under processing conditions rapidly undergo a cyclization reaction that leads to the release of the photographically useful group. This is true when the novel timing group of this invention is used with a heterocyclic nitrogen carrier group, such as a pyrazolone coupler, as well as when it is used with other carrier groups.

DETAILED DESCRIPTION OF THE INVENTION

The novel timing group of this invention can be the only group which intervenes between the carrier group and the photographically useful group, or there can be another timing group between the timing group and the carrier group, between the timing group and the photographically useful group, or between both of these pairs. Thus, in a particular embodiment, the release compound of this invention can be represented by the structure:

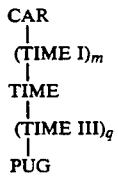

wherein:

CAR is a carrier group from which the remainder of the molecule is released during photographic processing;

PUG is a photographically useful group;

TIME is as defined above;

TIME I is a timing group;

TIME III is a timing group;

and and m and q are each independently 0 or 1.

In the novel release compounds of this invention the carrier group, CAR, can be a blocking group formed from a silyl group or from a carboxylic, sulfonic, phosphonic, or phosphoric acid derivative, and which releases the timing group in a non-imagewise manner by hydrolysis. A preferred such blocking group is described in Buchanan et al, U.S. Pat. No. 5,019,492.

Alternatively, CAR can be an oxidizable moiety, such as a hydrazide or hydroquinone derivative, which releases the timing group in an imagewise manner as a function of silver halide development. Such blocking groups are described, for example, in U.S. Pat. Nos. 3,379,529 and 4,684,604.

In a preferred embodiment of this invention, CAR is a coupler moiety to whose coupling position the timing group is attached, so that it is coupled off by reaction with oxidized color developing agent formed in an imagewise manner as a function of silver halide development. The coupler moiety can be any coupler that forms a colored or colorless, diffusible or nondiffusible reaction product with oxidized silver halide developing agent. Representative coupler moieties are derived from phenol, naphthol, pyrazolone, pyrazoloazole, and acylacetamide couplers by replacing the atom in the coupling position of the coupler with the remainder of the molecule. In a particularly preferred embodiment of this invention, CAR is a heterocyclic coupler, such as a pyrazolone or a pyrazoloazole.

When CAR is divalent, multivalent, or polymeric, it is capable of releasing more than one timing group. To immobilize the release compound when it is incorporated in a photographic element, a ballast group may be attached to or more of the carrier group and the timing group.

The timing groups represented by TIME I and TIME III can be one or more other timing groups of this invention, or can be one or more other timing groups known in the art, such as those which release the remainder of .the molecule by an intramolecular nucleophilic displacement reaction and those which release the remainder of the molecule by a reaction involving electron transfer along a conjugated chain. Suitable timing groups are described in U.S. Pat. Nos. 4,248,962; 4,409,323; 4,861,701; 4,500,633; 5,034,311 and 5,055,385.

In a preferred embodiment, the novel timing group of this invention is joined directly to the carrier group; i.e., m in the above structure is 0. In that preferred embodiment, it is preferred that, if TIME III is present, it be a quinone methide timing group.

In another embodiment of this invention, both m and q in the above structure are 0.

As shown above, the timing group of this invention, TIME, contains a nucleophile Nu, which is joined to a position on CAR (m=0) from which it can be released during photographic processing, such as the coupling position of a coupler. Alternately, TIME can be released through an intervening timing group, TIME I (m=1), and in this case Nu is attached to the electrophilic end of TIME I.

Representative Nu groups contain electron rich oxygen, sulfur, and nitrogen atoms. In the following listing of representative Nu groups, the groups are oriented so that the left hand bond of Nu is joined to CAR (when m=0) or to TIME I (when m=1) and the right hand bond of Nu is attached to LINK (when p=1) or to E (when p=0).

Representative Nu groups include:

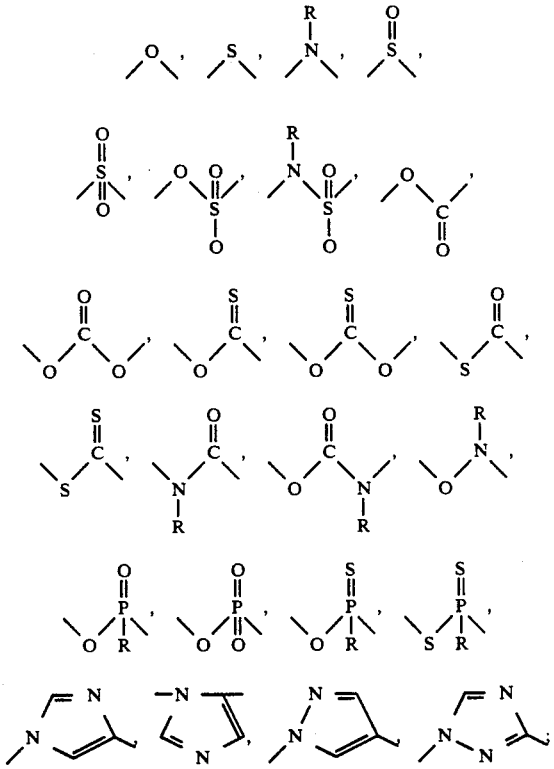

where each R is independently hydrogen, alkyl, of 1 to 20 carbon atoms or aryl of 6 to 20 carbon atoms, including alkaryl, aralkyl and substituted alkyl and aryl groups.

Preferably R is hydrogen, alkyl of 1 to 4 carbon atoms or aryl of 6 to 10 carbon atoms. Suitable substituents include chloro, bromo, fluoro, hydroxy, carboxy, carbonamido, sufonamido, sulfonyl, and the like. Representative R groups include methyl, ethyl propyl, hexyl, decyl, pentadecyl, octadecyl, carboxyethyl, hydroxypropyl, sulfonamidobutyl, phenyl, naphthyl, benzyl, tolyl, t-butylphenyl, carboxyphenyl, chlorophenyl, hydroxyphenyl, and the like.

A preferred Nu group is —S—.

The nucleophilic group, Nu, is joined to E (p=0) or to LINK (p=1). The linking group, LINK, serves to keep Nu and E in an advantageous spatial relationship for a ring closure reaction by which Nu displaces the group joined to E. Since such reactions proceed most readily with the formation of a 4 to 8 membered ring, LINK should be such that there are 1 to 5 atoms in the direct path containing the atom joined to Nu and the atom joined to E. Suitable linking groups should be chemically inert and stable.

In the listing of representative LINK groups below, the left hand bond of LINK is joined to Nu and the right hand bond of LINK is joined to E:

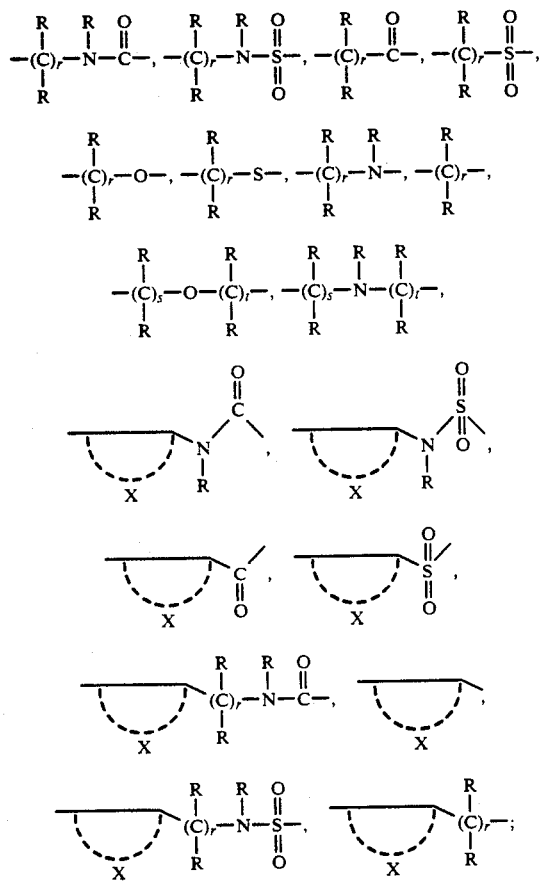

wherein:

each R is as defined above;

X represents the atoms necessary to complete an aromatic or heteroaromatic system comprising of one or two rings; and r,s,t are each independently integers of 0 to 4.

If X is a bicyclic system, one or both rings can be involved in the linking function.

Preferably LINK is an alkylamido group or an arylamido group having 6 to 10 carbon atoms.

The point of attachment of LINK to E depends on the particular aromatic ring system which forms E. When E is a single aromatic ring, LINK is connected to the carbon which is vicinal to the electrophilic carbon. When E is a bicyclic system, LINK can be attached to the ring that contains the electrophilic carbon, in which case it is attached to the same position as in the single ring system, or it can be attached to a different ring, in which case it is attached to an atom which is in a peri position with respect to the electrophilic carbon. This is illustrated by the schematic Cases A, B and C, below.

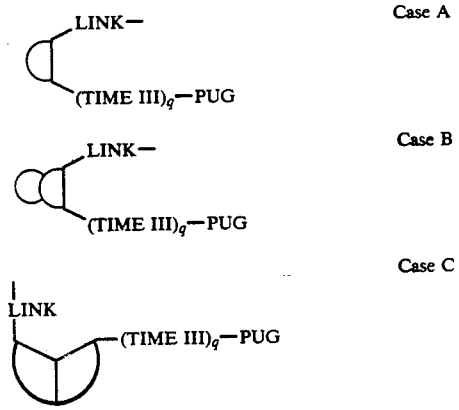

The electrophilic group comprises an aromatic ring system which can be substituted with one or more electron withdrawing groups and which contains as an electrophilic center, an electron deficient carbon atom to which the photographically useful group is attached, either directly or indirectly thru another timing group. Nu, E and the groups joined to them are so chosen that upon release of Nu from CAR, under photographic processing conditions, Nu interacts with E so as to displace from E the photographically useful group or timing group joined to it.

The location of electrophilic centers in E, as well as their reactivity towards Nu, will depend upon the number and disposition of nitrogen atoms in the ring and the number and disposition of electron withdrawing groups substituted on the ring. It may be desirable to have between 0 and 4 nitrogen atoms and to have between 0 and 4 electron withdrawing substituents, depending on the particular ring and the identity of the particular LINK and PUG or TIME III groups attached to it.

Representative aromatic ring systems which form the electrophilic group E include benzene, pyridine, pyrazine, pyrimidine, naphthalene, quinoline, isoquinoline, quinazoline, quinoxaline and the like.

Particularly useful electron withdrawing groups for attachment to the aromatic ring include nitro, cyano, fluoro, sulfonamido ($SO_2N(R)_2$), carbonamido ($CON(R)_2$), and carboxy ($CO_2R$), where R is defined as above. Other useful electron withdrawing groups will be apparent to those skilled in the art from a consideration of such texts as J. March "Advanced Organic Chemistry", John Wiley and Sons, New York, Chichester, Brisbane, Toronto, Singapore, 1985, p.456. It is particularly preferred for LINK to be joined to E via a sulfonamido or carbonamido group.

PUG is a photographically useful group made available during processing by release from TIME. It is joined to the electron deficient carbon atom in E via a nucleophilic atom in PUG.

PUG can be a dye or dye precursor, such as a sensitizing dye, filter dye, image dye, leuco dye, blocked dye, shifted dye, or ultraviolet light absorber. Alternatively PUG can be a photographic reagent, which upon release can further react with components in the element. Such reagents include development accelerators, development inhibitors, bleach accelerators, bleach inhibitors, couplers (e.g. competing couplers, color-forming couplers, or DIR couplers), developing agents (e.g. competing developing agents or auxiliary developing agents), silver complexing agents, fixing agents, toners, hardeners, tanning agents, fogging agents, antifoggants, antistain agents, stabilizers, nucleophiles and dinucleophiles, and chemical or spectral sensitizers and desensitizers.

In an especially preferred embodiment of this invention, the release compound is represented by the structure:

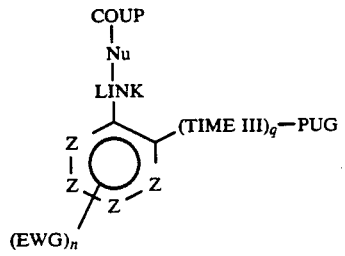

wherein:

COUP is a coupler moiety from which the remainder of the molecule is released during photographic processing;

Nu and LINK are as defined above;

EWG is an electron withdrawing group;

each Z is N or C-R', where R' is H or a monovalent substituent, including EWG;

TIME III is a timing group;

PUG is a photographically useful group;

n is an integer 0 to 3 and q is 0 or 1.

Suitable monovalent substituents represented by R' include electron withdrawing groups, as described above, as well as other groups, such as chloro, bromo, alkyl, aryl, alkoxy, aryloxy, alkylthio, arylthio, amino, and amido. The alkyl and arlyl portions of these groups can be unsubstituted or substituted with other groups.

Structures of some release compounds of the invention are shown below in TABLE 1, as follows:

TABLE 1

(1)

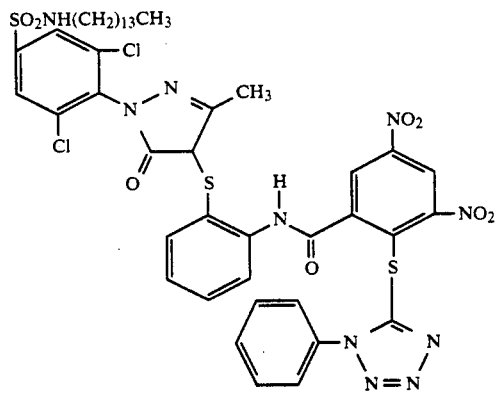

(2)

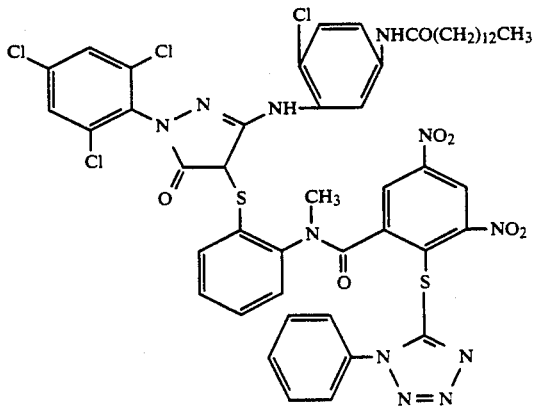

TABLE 1-continued
(3)
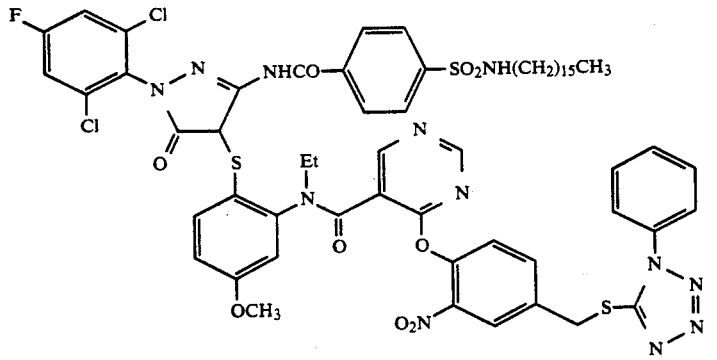
(4)
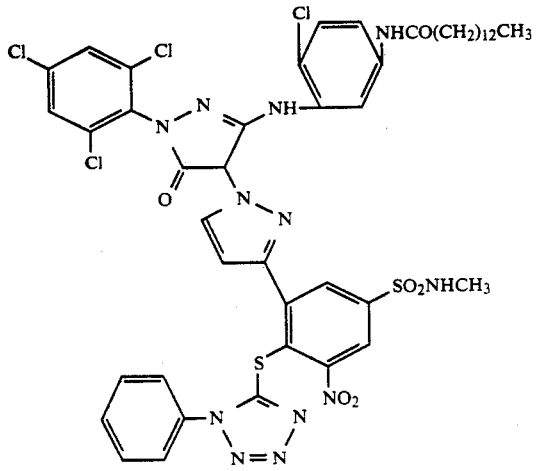
(5)
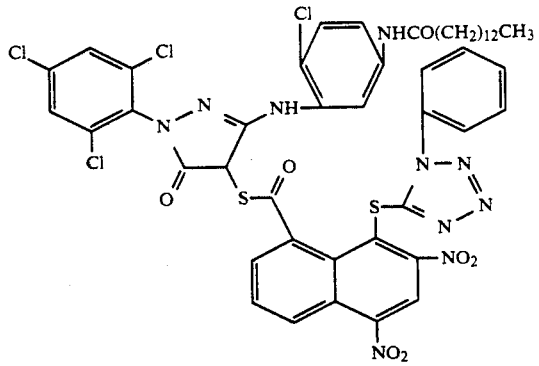
(6)
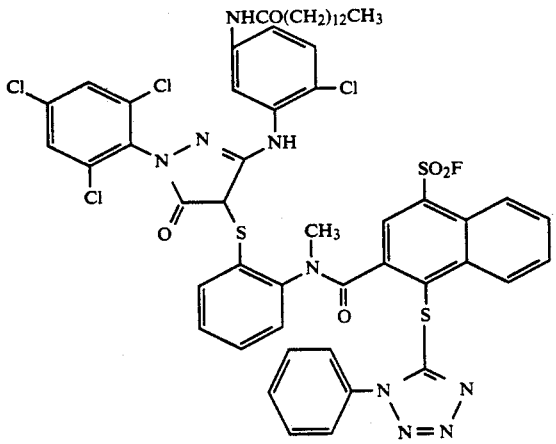

TABLE 1-continued
(7)
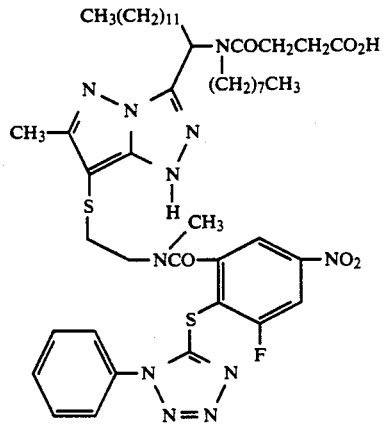
(8)
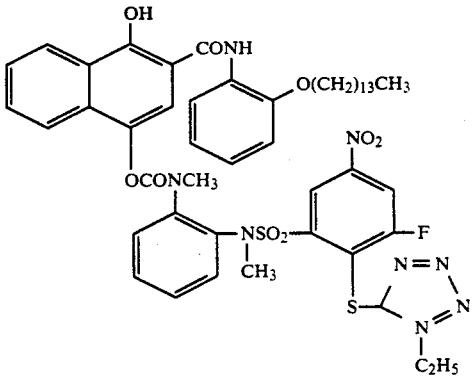
(9)
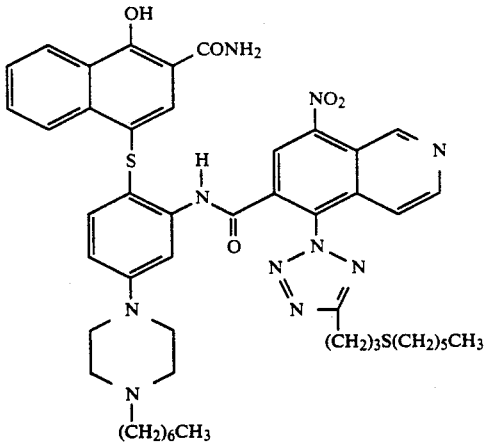
(10)
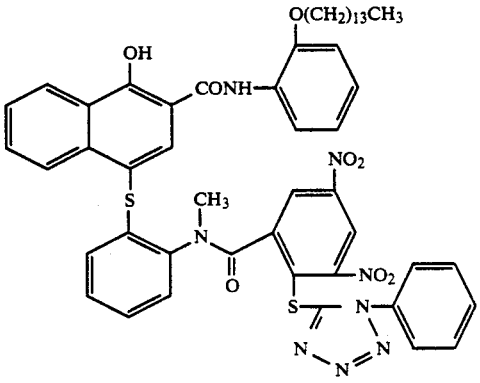

TABLE 1-continued
(11)
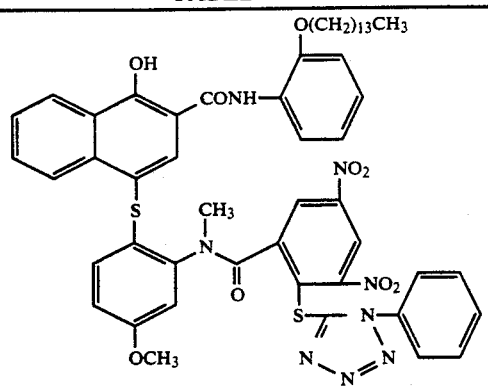
(12)
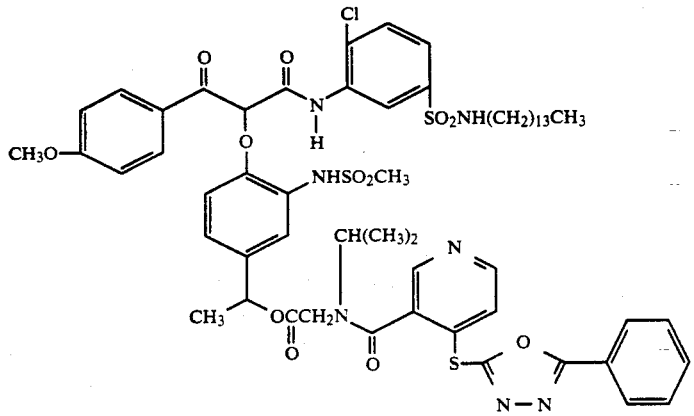
(13)
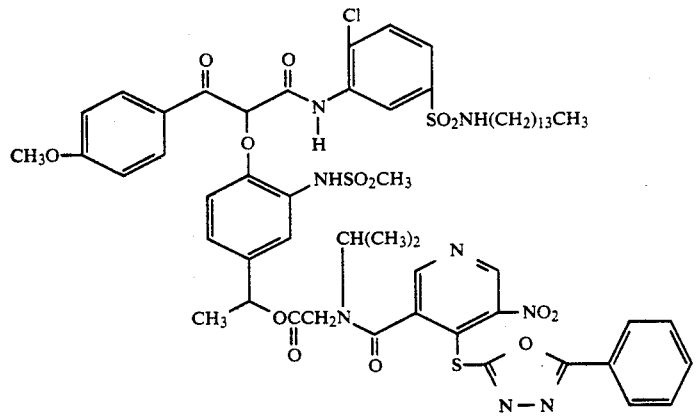
(14)
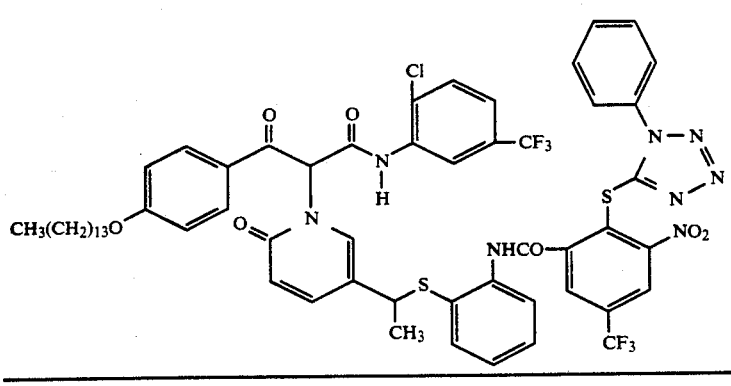
The compounds employed in this invention can be prepared by synthetic procedures well known in the art. Generally, this involves first the preparation of a suitable precursor of the timing group followed by its attachment to the carrier group. The photographically useful group is then connected to the timing group.

The release compounds can be used and incorporated in photographic elements in the way that such compounds have been used in the past. Depending upon the nature of the particular photographically useful group, the release compound can be incorporated in a photographic element for different purposes and in different locations and these elements can contain various other components. Reference will be made to exemplary ways in which preferred photographically useful groups can be incorporated.

When the photographically useful group released is a development inhibitor, it can be employed in a photographic element as described, for example, in U.S. Pat. Nos. 3,227,554; 3,620,747; 3,703,375; 4,248,962 and 4,409,323. Compounds of this invention which release a development inhibitor can be contained in, or in reactive association with, one or more of the silver halide emulsion units in a color photographic element. If the silver halide emulsion unit is composed of more than one layer, one or more of such layers can contain the compound of this invention. The layers can contain other photographic couplers conventionally used in the art. The couplers of this invention can form dyes of the same color as the color forming coupler(s) in the layer or unit, it can form a dye of a different color, or it can result in a colorless or neutral reaction product. The range of operation of the development inhibitor between layers when released from the coupler of this invention can be controlled by the use of scavenger layers, such as a layer of a fine grain silver halide emulsion. Scavenger layers can be in various locations in an element containing couplers of this invention. They can be located between layers, between the layers and the support, or over all of the layers.

Release compounds of this invention which release bleach inhibitors can be employed in the ways described in U.S. Pat. No. 3,705,801, to inhibit the bleaching of silver in selected areas of a photographic element.

Release compounds of this invention which release a dye or dye precursor can be used in processes where the dye is allowed to diffuse to an integral or separate receiving layer to form a desired image as described for example in U.S. Pat. Nos. 3,227,551; 3,443,940 and 3,751,406. Alternatively, the dye can be retained in the location where it is released to augment the density of the dye formed from the coupler from which it is released or to modify or correct the hue of that dye or another dye. In another embodiment, the released dye can be completely removed from the element and the dye which was not released from the coupler can be retained in the element as a color correcting mask.

Release compounds of this invention in which the photographically useful group is a coupler can be employed to release another coupler. If the released coupler is a dye-forming coupler it can react with oxidized developing agent in the same or an adjacent layer to form a dye of the same or a different color or hue as that obtained from the primary coupler. If the released coupler is a competing coupler it can react with oxidized color developing agent in the same or an adjacent layer to reduce dye density.

Release compounds of this invention in which the photographically useful group is a developing agent can be used to release a developing agent which will compete with the color forming developing agent, and thus reduce dye density. Alternatively, they can provide, in an imagewise manner, a developing agent which because of such considerations as activity would not desirably be introduced into the element in a uniform fashion.

Release compounds of this invention in which the photographically useful group is a nucleating agent, can be used to accelerate development.

Release compounds of this invention which release bleach accelerators can be employed to accelerate the bleaching of silver in the photographic element.

The photographic elements can be single color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. Pat. No. 4,362,806 issued Dec. 7, 1982.

In the following discussion of suitable materials for use in the emulsions and elements of this invention, reference will be made to *Research Disclosure,* December 1989, Item 308119, published by Kenneth Mason Publications, Ltd., Dudley Annex, 12a North Street, Emsworth, Hampshire P010 7DQ, ENGLAND, the disclosures of which are incorporated herein by reference. This publication will be identified hereafter by the term "Research Disclosure".

The silver halide emulsions employed in the elements of this invention can be either negative-working or positive-working. Suitable emulsions and their preparation are described in Research Disclosure Sections I and II and the publications cited therein. Suitable vehicles for the emulsion layers and other layers of elements of this invention are described in Research Disclosure Section IX and the publications cited therein.

In addition to the couplers generally described above, the elements of the invention can include additional couplers as described in Research Disclosure Section VII, paragraphs D, E, F and G and the publications cited therein. These couplers can be incorporated in the elements and emulsions as described in Research Disclosure Section VII, paragraph C and the publications cited therein.

The photographic elements of this invention or individual layers thereof, can contain brighteners (see Research Disclosure Section V), antifoggants and stabilizers (See Research Disclosure Section VI), antistain agents and image dye stabilizers (see Research Disclosure Section VII, paragraphs I and J), light absorbing and scattering materials (see Research Disclosure Section VIII), hardeners (see Research Disclosure Section IX), plasticizers and lubricants (See Research Disclosure Section XII), antistatic agents (see Research Disclosure Section XIII), matting agents (see Research Disclosure Section XVI) and development modifiers (see Research Disclosure Section XXI).

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

The following example illustrates the preparation of a release compound of this invention.

PREPARATIVE EXAMPLE 1

PREPARATION OF COMPOUND (2)

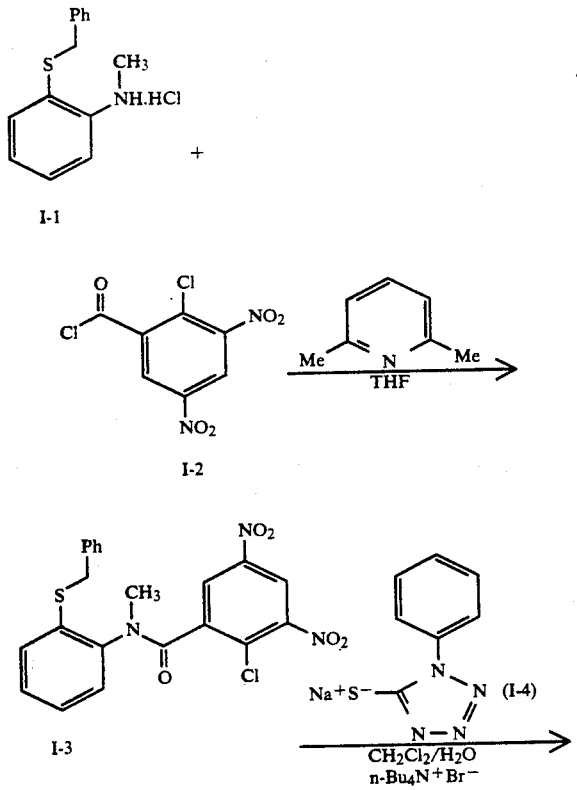

-continued

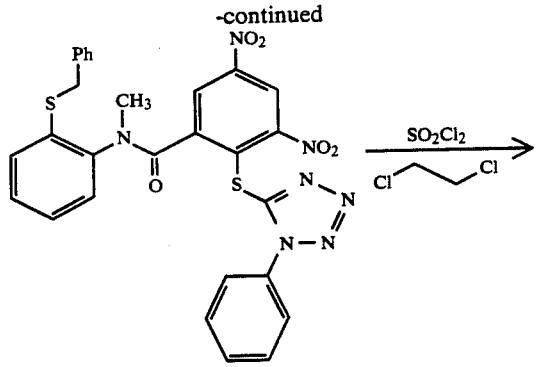

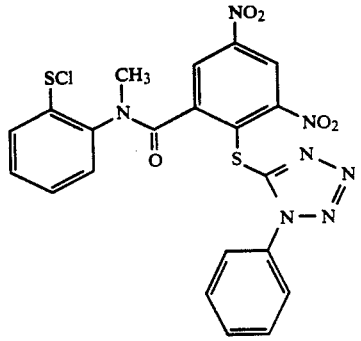

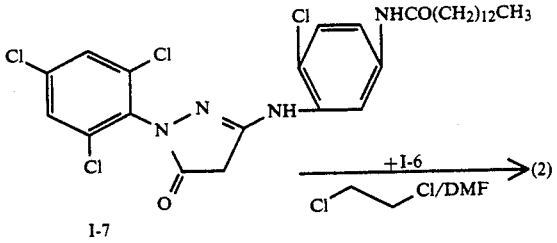

Preparation of I-3

A solution of 2,6-lutidine (4.28 g; 40 mmole) in 15 ml of THF was added at 5° C. to a mixture of I-1 (5.32 g; 20 mmole) and I-2 (5.30 g; 20 mmole) in 60 ml of THF. The mixture was kept at room temperature for 24 hours and then worked up with ethyl acetate and diluted hydrochloric acid. The crude product was purified with diisopropyl ether and ligroin.

Yield: 6.19 g (13.5 mmole; 68%)

Preparation of I-5

A solution of I-3 (6.19 g; 13.5 mmole) in 100 ml of dichloromethane and a solution of I-4 (4.00 g; 20 mmole) and tetra-n-butylammonium bromide (0.1 g) in 50 ml of water was stirred for 24 hours. The layers were separated, the organic one dried and taken to dryness giving a crude product which was recrystallized from methanol.

Yield: 5.25 g (8.8 mmole; 65%)

Preparation of I-6

A solution of sulfuryl chloride (0.65 g; 4.8 mmole) in 2 ml of dichloroethane was added at 5° C. to a slurry of I-5 (2.40g; 4 mmole) in 10 ml of dichloroethane. After 1 hour at room temperature the resultant yellow solution was concentrated to an oil.

Yield assumed quantitative.

Preparation of (2)

A solution of I-6 (appx. 4 mmole) in 15 ml of dichloroethane was added to a solution of I-7 (2.03 g; 3.3 mmole) in 100 ml of dimethylformamide, stirred for 4 hours and worked up with ethyl acetate and diluted hydrochloric acid. The crude product was purified by column chromatography.

Yield: 2.91 g ( 2.6 mmole; 79%)

The following examples illustrate photographic elements containing release compounds of this invention.

EXAMPLES

Pairs of photographic elements, which differed only in that one contained a release compound of this invention and the other did not were prepared having the common layer arrangement shown below. The element which contains the release compound is identified as the Invention element and the one without it is identified as the Control element. (In the following elements, unless otherwise indicated, the numbers in parentheses represent the coverage in g/m$^2$.)

| Elements 1 had the following components. |
|---|
| Overcoat Layer: |
| Gelatin-(2.7); |
| Bisvinylsulfonylmethyl ether hardener-(1.7% by of total gelatin in the element) |
| Emulsion Layer: |
| Gelatin-(3.8); |
| Green-sensitized silver bromoiodide, 6.4% iodide, 0.46 micrometer average grain size-(1.6); |
| Magenta dye-forming coupler M (see below)-(0.7) dispersed in tritolyl phosphate; |
| Release Compound 2 (see Table 1, above) -(0.12) dispersed in tritolyl phosphate |
| Cellulose Acetate Support |

Coupler M

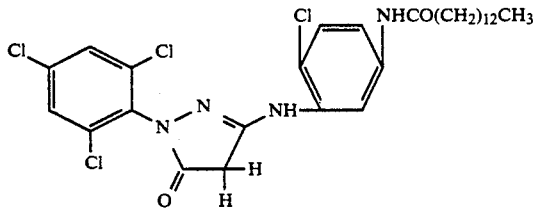

A second pair of elements, Elements 2, was prepared with the same components as Elements 1, except that they contained the Cyan image dye forming coupler C (see below)-(0.8) dispersed in dibutyl phthalate in place of coupler M and Element 2-Invention contained Release compound 10 (see Table 1, above)-(0.10) dispersed in diethyl lauramide.

Coupler C:

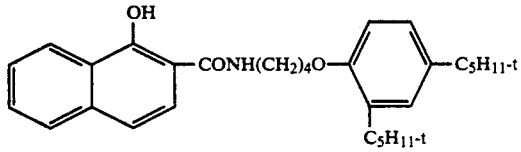

A third pair of elements, Elements 3, was prepared with the same components as Elements 2, except that the silver halide emulsion was a Red-sensitized, silver bromoiodide tabular grain emulsion having 3% iodide, an average grain diameter of 0.75 and an average aspect ratio of 5.8-(1.07).

A fourth pair of elements, Elements 4, was prepared with the same components as Elements 2, except that the release compound was Release compound 11 (see Table 1) (0.11).

Strips of each element were exposed stepwise to green and red light followed by processing at 38° C. as follows:

| | |
|---|---|
| Developer | 3'15" |
| Stop | 30" |
| Wash | 2' |
| Bleach | 3' |
| Wash | 3' |
| Fix | 4' |
| Wash | 3' |
| Stabilizer | 30" |

The color developer composition was:

| | |
|---|---|
| Water | 800.0 ml |
| Potassium carbonate, anh. | 34.30 g |
| Potassium bicarbonate | 2.32 g |
| Sodium sulfite, anhydrous | 0.38 g |
| Sodium metabisulfite | 2.78 g |
| Potassium iodide | 1.20 mg |
| Sodium bromide | 1.31 g |
| Diethylenetriamine pentaacetic acid, pentasodium salt (40% solution) (KODAK Anti-Calcium No. 8) | 8.43 g |
| Hydroxylamine sulfate (HAS) | 2.41 g |
| Developing Agent* | 4.52 g |
| Water to make | 1.00 L |

*4-Amino-3-methyl-N-ethyl-N-beta-hydroxyethylaniline sulfate

Processed images were read with green or red light to determine Contrast and Percent Contrast. Percent Contrast is defined as the contrast of an element containing the release compound divided by the contrast of an element without the release compound. The Contrast for each of the elements and the Percent Contrast the elements containing release compounds is shown in Table 2, below.

The results shown in Table 2, demonstrate that the release compound remained in the element in a form that would release a development inhibitor and that the development inhibitor was released in the element during processing in sufficient time to reduce the contrast of the image.

TABLE 2

| ELEMENT | RELEASE COMPOUND | CONTRAST | CONTRAST RATIO |
|---|---|---|---|
| 1-Control | none | 1.43 | — |
| 1-Invention | 2 | 0.90 | 0.63 |
| 2-Control | none | 2.00 | — |
| 2-Invention | 10 | 0.59 | 0.30 |
| 3-Control | none | 1.54 | — |
| 3-Invention | 10 | 0.41 | 0.27 |
| 4-Control | none | 2.00 | — |
| 4-Invention | 11 | 0.73 | 0.37 |

The invention has been described in detail with particular reference to preferred embodiments thereof, but it will be understood that variations and modifications can be effected within the spirit and scope of the invention.

What is claimed is:

1. A photographic element comprising a support bearing a silver halide emulsion layer having associated therewith an image dye forming coupler and a release compound comprising a carrier group, a timing group and a photographically useful group, wherein the timing group is represented by the formula:

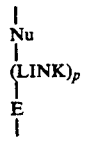

wherein:

Nu is a nucleophilic group;

E is an electrophilic group, comprising a carbo- or hetero- aromatic ring, containing an electron deficient carbon atom;

LINK is a linking group which provides 1 to 5 atoms in the direct path between the nucleophilic site of Nu and the electron deficient carbon atom in E, thereby providing the spatial relationship between Nu and E that permits a ring closure reaction by which Nu displaces the photographically useful group attached to E;

p is 0 or 1;

the photographically useful group is attached to an electron deficient carbon atom in E directly or through another timing group; and the nucleophilic group is joined, directly or thru an intervening timing group, to a position on the carrier group from which it is released during photographic processing.

2. A photographic element of claim 1 wherein the electrophilic group, E, is an aromatic ring system comprising a carbocylic or heterocyclic ring to which is attached 1 to 4 electron withdrawing groups.

3. A photographic element of claim 1 wherein the carrier group is a photographic coupler having Nu attached to its coupling position directly or thru an intervening timing group, and from which Nu is released in an imagewise manner as a function of silver halide development.

4. A photographic element of claim 3 wherein the coupler is a pyrazolone.

5. A photographic element of claim 3 wherein Nu is joined directly to the coupling position of the carrier group.

6. A photographic element of claim 1, wherein the photographically useful group is joined directly to the electron deficient carbon atom in E.

7. A photographic element of claim 1 wherein the photographically useful group is a development inhibitor.

8. A photographic element of claim 1 wherein the photographically useful group is a bleach accelerator.

9. A photographic element of claim 1 wherein the release compound is represented by the structure:

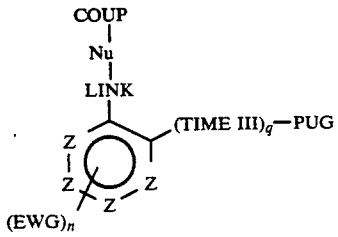

wherein:

COUP is a coupler moiety from which the remainder of the molecule is released during photographic processing;

Nu and LINK are as defined above;

EWG is an electron withdrawing group;

each Z is N or C-R', where R' is H or a monovalent substituent, including EWG;

TIME III is a timing group;

PUG is a photographically useful group;

n is an integer 0 to 3 and q is 0 or 1.

10. A photographic element of claim 1 wherein the release compound has one of the structures:

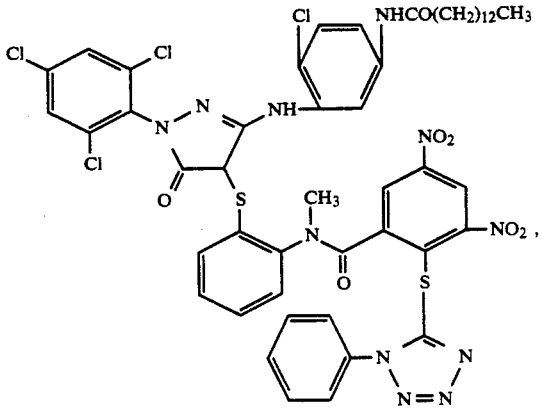

-continued
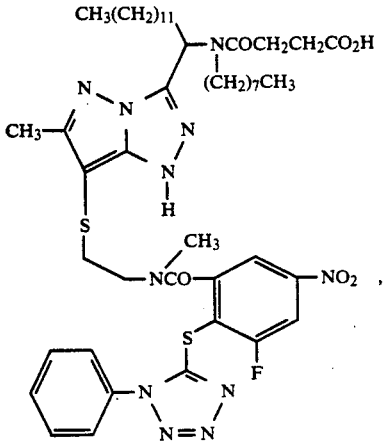
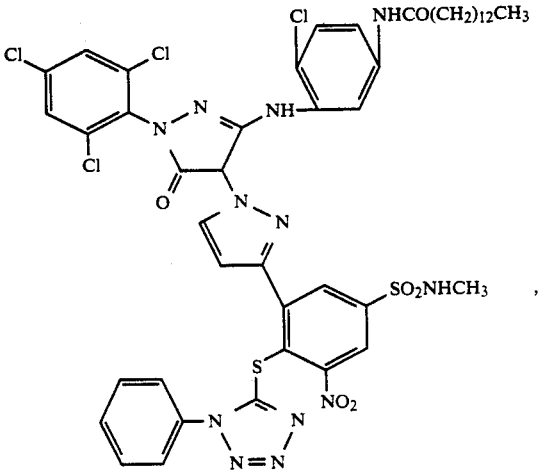
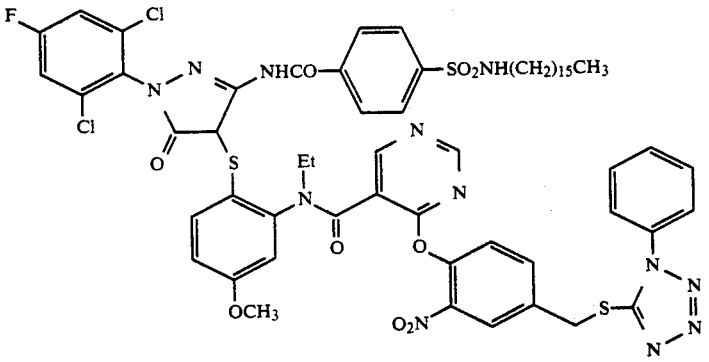
or
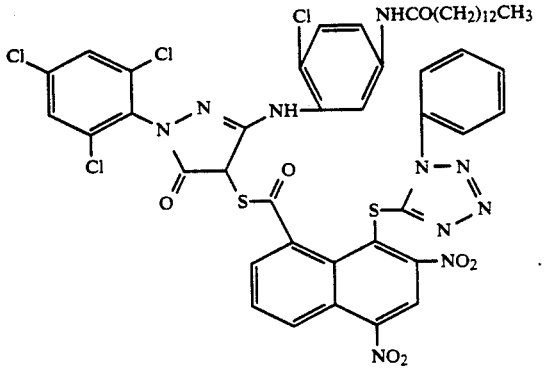
* * * * *